United States Patent [19]

de Solminihac

[11] Patent Number: 5,006,831

[45] Date of Patent: Apr. 9, 1991

[54] DEVICE PROVIDING FOR THE SAFETY OF A MAN OVERBOARD

[75] Inventor: Francois de Solminihac, Brest, France

[73] Assignee: Thomson-CSF, Puteaux, France

[21] Appl. No.: 409,309

[22] Filed: Sep. 19, 1989

[30] Foreign Application Priority Data

Sep. 23, 1988 [FR] France ..... 88 12464

[51] Int. Cl.[5] ..... G08B 13/14

[52] U.S. Cl. ..... 340/573; 340/539; 455/100; 441/89; 441/123

[58] Field of Search ..... 340/573, 531, 539; 441/6, 11, 12, 89, 80, 88, 106, 108, 123, 81, 113; 114/343, 345; 455/95, 98, 99, 100

[56] References Cited

U.S. PATENT DOCUMENTS

| | | | |
|---|---|---|---|
| 3,132,322 | 5/1964 | Maes | 441/11 |
| 3,229,311 | 1/1966 | Maes | 441/11 |
| 3,810,146 | 5/1974 | Lieb | 340/573 |
| 4,305,143 | 12/1981 | Simms et al. | 340/573 |
| 4,630,205 | 12/1986 | Otaka | 441/80 |
| 4,702,715 | 10/1987 | Winick | 441/6 |
| 4,714,914 | 12/1987 | Boe | 340/573 |
| 4,813,025 | 3/1989 | Rowland et al. | 441/89 |

FOREIGN PATENT DOCUMENTS

WO81/00496 2/1981 PCT Int'l Appl. ..... 340/573

OTHER PUBLICATIONS

Patent Abstracts of Japan, vol. 9, No. 149 (M-390) (1872), Jun. 25, 1985; and JP-A-60 25 880, Feb. 8, 1985, M. Sawada, "Automatic Sea Sufferer Rescuing Equipment".

*Primary Examiner*—Reinhard J. Eisenzopf
*Assistant Examiner*—Geoff Sutcliffe
*Attorney, Agent, or Firm*—Oblon, Spivak, McClelland, Maier & Neustadt

[57] ABSTRACT

The device has a source of acoustic signals placed beneath the hull of the boat, a beacon, an alarm pack worn by the navigator around the neck. If the navigator falls overboard, an acoustic sensor built into the pack detects the emission of the source and actuates the jettisoning of the beacon by remote control. This beacon has a measuring head fitted out with a directional acoustic sensor and a compass capable of computing information on the position of the beacon, transmitted by radio to a control box fixed in the boat. As the beacon is supposed to be near the castaway or man overboard, he is thus found.

2 Claims, 2 Drawing Sheets

DEVICE PROVIDING FOR THE SAFETY OF A MAN OVERBOARD

BACKGROUND OF THE INVENTION

1. Field of the Invention

The present invention pertains to a device for the rescue of a person who has fallen out of a nautical vehicle and, particularly, to a device such as this, of the type including means of assistance taken on board the vehicle and designed to be put into the water upon command by a radio-electrical signal which is automatically emitted by an emitter of signals such as this, built into an alarm pack carried by the person when he comes into the water.

Searching for a person in the sea, even in medium weather conditions, is difficult because it is not easy to distinguish a person's head accurately on the rough surface of the sea. Moreover, it is not easy to bring the ship back to the position where this fall has occurred, namely to the exact position of the fall.

2. Description of the Prior Art

There is a known device, described in the French patent application No. 2.550.020 by A. Neveu and G. Salaun, making it possible to jettison a buoy, without manual intervention, as soon as a man has fallen overboard. As soon as the person is in the water, an emitter of radio-electric signals is turned on through the closing of electrical contacts by conduction of water, or else manually, by the operator, if he is capable of this. The radio signal is received on board the vessel, from which the fall has taken place, by a receiver which activates the jettisoning of a rescue buoy as well as the illumination of a flashing beacon and an alarm siren. In addition, the receiver then actuates the stoppage of the motor and, if necessary, that of the automatic guidance system. The buoy, having been thus jettisoned in a very short time, drifts in the same way as the castaway, following the winds or currents at a very short distance from him.

While this device makes it possible to increase the chances of survival of persons overboard or castaways, notably in the case of lone navigators, it nevertheless has major drawbacks.

Firstly, the jettisoning of the buoy through the closing of electrical contacts by means of water, is a source of false alarms because it often happens that a navigator gets wet on the bridge of the vessel, hence without falling overboard.

Furthermore, the person overboard or castaway himself is not located and it is then difficult to find him in a sufficiently short period because, generally, there is soon a large distance between the man overboard or castaway and his craft.

An object of the present invention, therefore, is the making of a device such as this enabling a person to be located at sea so that he can be quickly pulled out from it.

Another object of the present invention is to make a device to rescue a person at sea, the use of which is well protected from being triggered in an untimely way.

SUMMARY OF THE INVENTION

These aims of the present invention, as well as others which will appear subsequently, are achieved with a device for the rescue of a person who has fallen overboard from a nautical vehicle, comprising rescue means that are on board the vehicle and are designed to be put in the water under the control of a radioelectric signal automatically emitted by an emitter of signals such as this, built into an alarm pack carried by the person, when he reaches the water, this signal actuating the means for jettisoning the rescue means, a device wherein the vehicle is fitted out with a submerged acoustical device to emit acoustical signals in the water and wherein the alarm pack further includes an acoustic sensor which is sensitive to the signals that are propagated in the water from the acoustic source to actuate, in response, the emission of a radioelectric signal by the emitter built into this pack, this radioelectric signal being then picked up by a receiver installed in a vehicle to trigger the means for jettisoning the rescue means.

According to a first embodiment of the present invention, the rescue means consist of a beacon, fitted out with means enabling it to be localized, which include a submerged, directional acoustic sensor sensitive to the signals emitted by the acoustic source of the vehicle, a compass, electronic means for processing the signals delivered by the sensor and the compass and radio-electrical transmission means associated with these processing means to emit signals enabling the beacon to be localized, the radio-electrical receiver of the vehicle picking up these signals.

According to a second embodiment of the present invention, suited to the rescue of a lone navigator, the rescue means consist of a motor-driven and remote-controlled rescue vehicle fitted out with a submerged acoustic source, the alarm pack being fitted out with an acoustic sensor that is sensitive to the signals from this source and to the orientation of the source, to form the signals for the remote control of the engine of the rescue vehicle, so as to make this vehicle approach the navigator.

BRIEF DESCRIPTION OF THE DRAWINGS

In the appended drawings, given purely by way of an example.

DESCRIPTION OF PREFERRED EMBODIMENTS

Figure 1:
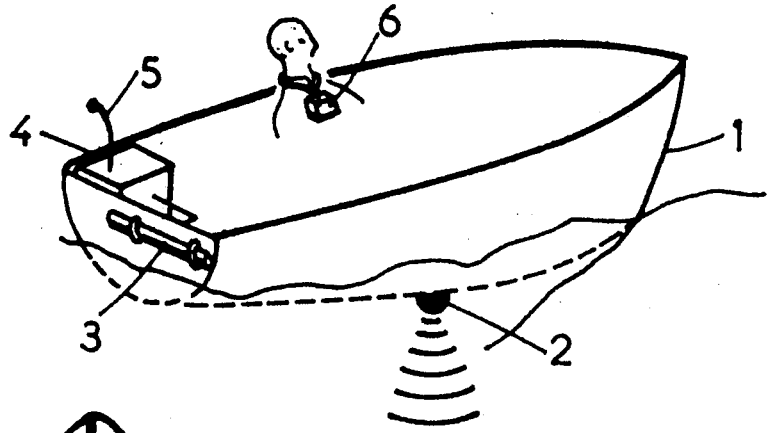
FIG. 1 gives a schematic view of a nautical vehicle fitted out with the device according to the invention.

Reference is made to FIG. 1 of the appended drawing, which gives a schematic view of a nautical vehicle such as a boat 1, fitted out with the device according to the present invention, essentially comprising:

an acoustic emission source 2 placed beneath the hull of the vessel and consisting of an acoustic pulse generating transducer known as a "pinger";

an acoustic and radio-electrical beacon 3, fixed to the rear of the vessel by a jettisoning device actuated as shall be described hereinafter;

an electronic control box 4, placed on board the vessel and provided with a radio antenna 5, the box being connected to the source 2 and to the device for jettisoning the beacon, and an individual alarm pack 6 carried around the neck by any person who is on board the vessel and could fall overboard.

The acoustic emission source 2 or pinger permanently emits acoustic pulses. It is controlled by an electronic module forming part of the case 4 (see FIG. 4).

Figure 3:
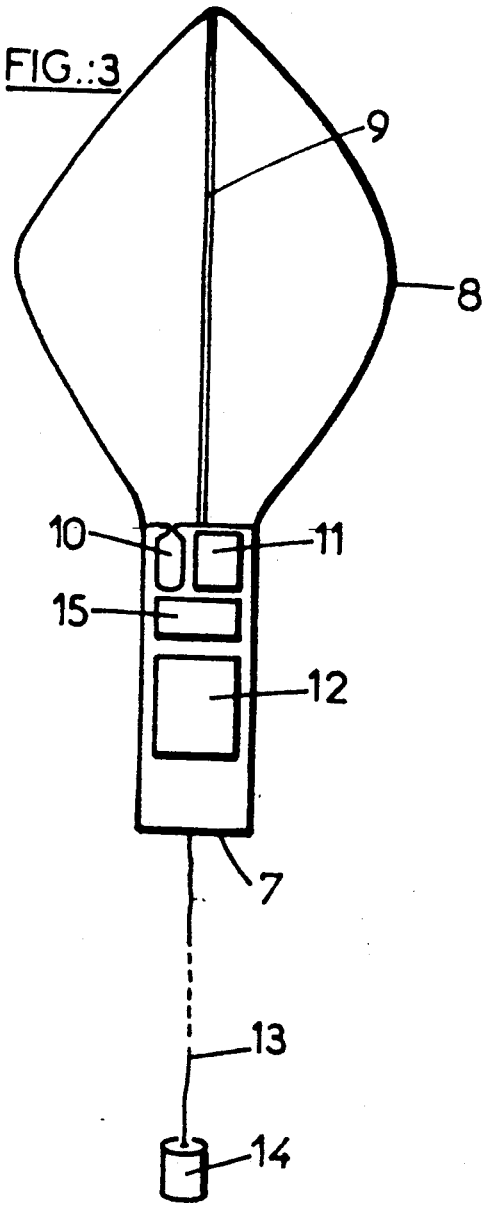
FIG. 3 gives a schematic view of a beacon forming part of an embodiment of the invention.

The beacon 3 is directly derived from the naval aviation underwater listening buoys that are air-dropped. It includes different elements (presented hereinafter) enclosed in a substantially cylindrical body, so as to have a positive floatability. After being jettisoned, the beacon gets deployed and assumes the configuration shown in FIG. 3. As shown in this figure, it comprises, in addition to the body 7:

a float 8/antenna 9 part consisting of a bag that gets inflated by means of a gas cartridge 10, the "whip" type antenna being unfolded inside the floater;

electronic means placed in the body 7 and consisting of an electronic module 15 for radio emission, acoustic reception and the processing of signals, and an electronic module 11 for the deployment of the float and the triggering of the cells of a supply cells unit 12;

a measuring head 14 which, when the beacon is deployed as shown in FIG. 3, remains suspended at the end of a wire 13. The measuring head 14 includes a directional acoustic sensor, called a hydrophone in the art, and a compass. The hydrophone is, for example, of the DIFAR (Directional Frequency And Ranging) type. The wire 13 enables the transmission of the signals picked up by the hydrophone and given by the compass to the electronic module 10. Before the deployment of the beacon, this wire is wound on a spool inside the body 7 of the beacon 3.

The directional hydrophone used in the measuring head 14 is formed, for example, by an association of four sensors, intersecting at 90 degrees, giving a signal proportionate to the sine of the direction of the received signal and a signal proportionate to the cosine of this direction.

Figure 2:
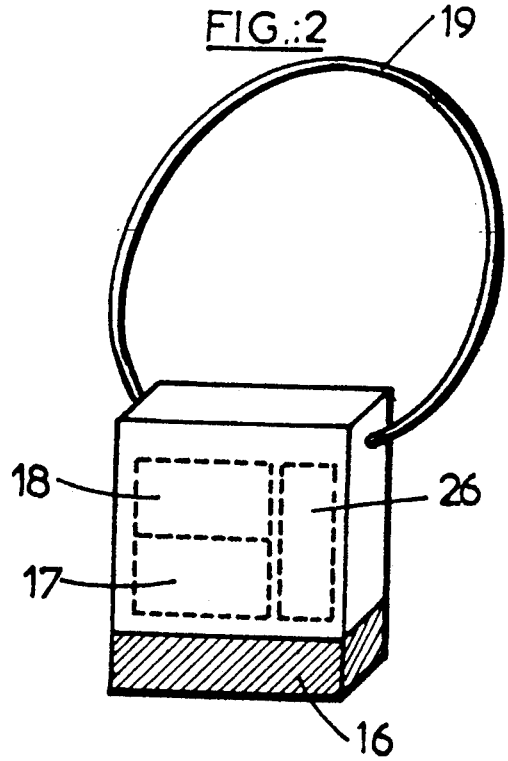
FIG. 2 gives a schematic view of an alarm pack forming part of the device of FIG. 1 and borne by any person, on board the vehicle, who could fall overboard.

FIG. 2 of the drawing represents the electronic alarm pack forming part of the device according to the present invention. This pack, which has the size of a match box, has an omnidirectional acoustic sensor or hydrophone 16, connected to an electronic module 17 for the reception of the acoustic signals, this electronic module actuating a VHF radio emission electronic module 18. The VHF antenna consists of a collar 19, supporting the pack around the neck. An electrical supply 26 completes the pack.

Figure 4:
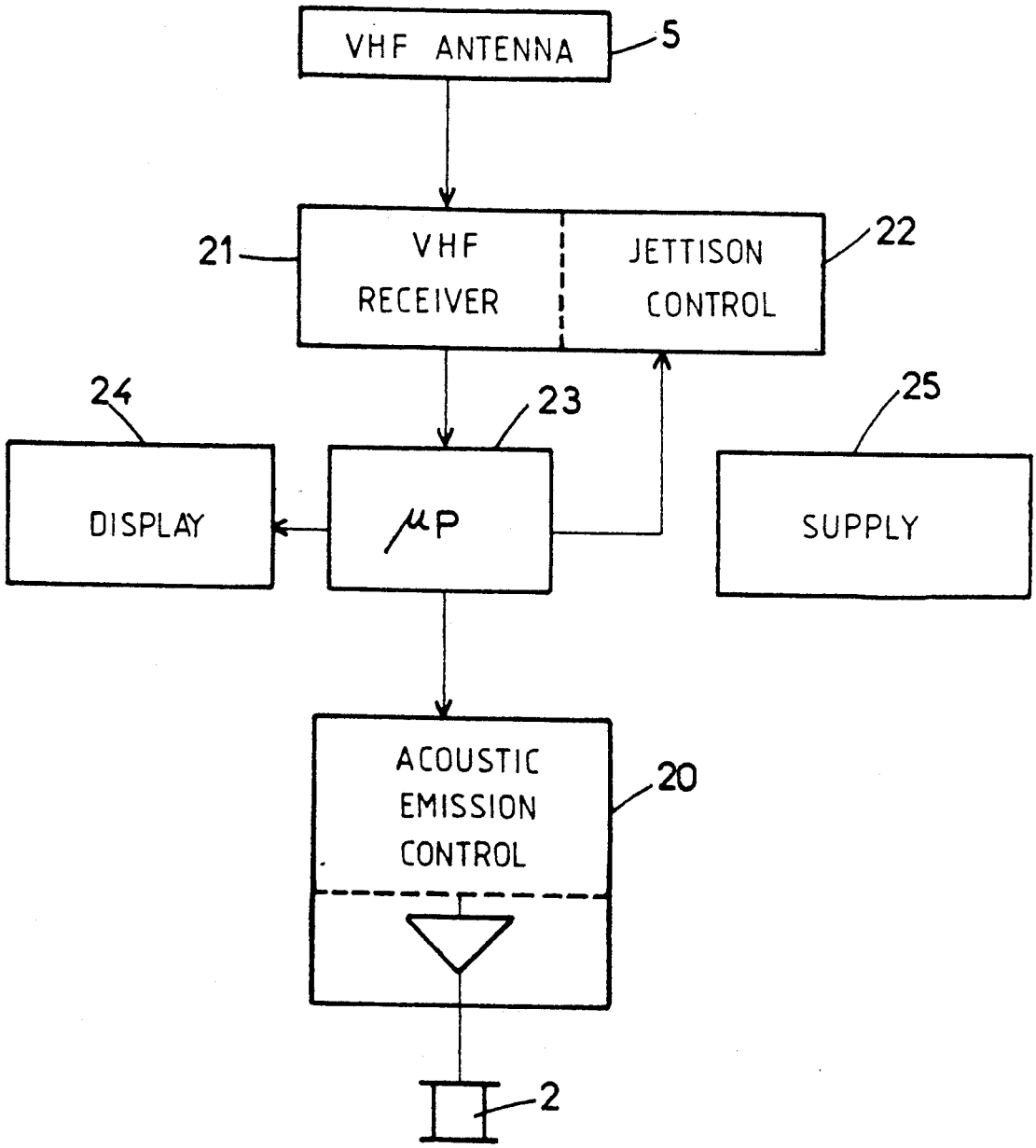
FIG. 4 is a functional diagram of electronic means forming part of a control box taken on board the vehicle and constituting one of the essential elements of the device according to the invention.

In the functional diagram of FIG. 4, it is seen that the control box 4 of the device according to the present invention essentially has an electronic module 20 for control of acoustic emission by the pinger 2, a VHF reception electronic module 21 associated with the electronic module 22 for controlling the jettisoning of the beacon, a microprocessor 23 to compute, notably, the distance of the beacon, and a display device 24 to display the course or direction and the distance of this beacon, on the case. The electrical supply 25 of the case is provided either by the onboard power system, if there is one, or by batteries.

The working of the rescue device according to the invention is established as follows. If a person fitted out with the individual alarm pack 6 falls overboard, the hydrophone 16 of this pack receives the acoustic pulse emitted by the source 2, and this reception generates a VHF radio signal which is emitted by the antenna collar 19.

The radio signal is then received by the antenna 5 of the case 4 which controls the jettisoning of the beacon 3. This jettisoning is obtained, for example, by the triggering of pyrotechnical means (not shown).

According to the present invention, therefore, a propagation of acoustic waves in water is used to trigger the jettisoning of the beacon 3. This propagation is detected only when the person fitted out with the alarm pack 5 has actually fallen into water. A detection of this kind is more reliable that one established by the wetting of electrical contacts, which may take place even when the person is still on the boat. This improvement in the reliability with which it is detected that someone has fallen overboard is a major advantage provided by the present invention.

It will be noted that, since the beacon 3 is jettisoned immediately and automatically, it falls into the water in the immediate vicinity of the man overboard or castaway, thus making it possible to deduce the references of his position from the references of the position of the beacon 3.

According to the present invention, the beacon is localized by means of the directional acoustic sensor which is in the measuring head 14, deployed beneath the beacon to receive the emissions from the acoustic source 2. The directional sensor can thus determine the bearing of the vehicle by means of the two signals delivered by this sensor, one of them proportionate to sine 0 and the other to cos 0, 0 being the bearing of the vehicle. With the information given by the compass built into the measuring head 14 of the beacon, the "signals processing" part of the electronic module 15 of the beacon encodes the information on the course that the vehicle should take to meet the man overboard or castaway and transmits the code in VHF to the case 4 of the craft, by means of the antenna 9 of the beacon and the antenna 5 of the case.

Means for measuring the instant (not shown) at which the signal is emitted by the acoustic source 2 of the vehicle, and the instant of reception of the radio signal emitted by the beacon 3 upon reception of the acoustic signal, give the microprocessor 23 (see FIG. 4), the time interval enabling it to compute the beacon/vehicle distance and hence the distance between the beacon and the man overboard or castaway who is assumed to be close to the beacon 3. The microprocessor then actuates the display device 24 for diplaying the course and distance of the castaway or man overboard.

Numerous variants can be proposed to the rescue device described and shown, which has been given purely by way of example.

In particular, the device may further comprise alarm devices which are triggered simultaneously with the jettisoning of the beacon. For example, this beacon may be fitted out with a flash bulb and may, possibly, emit a smoke-producing substance, as a method for the optical signalling of the position of this beacon. The float deployed from the beacon may also be conformed so that it can serve as a support to which the castaway or man overboard may cling if necessary. The beacon may again be fitted out with a water-proof loudspeaker and a radiophonic link between the craft and the beacon to set up voice contact with the castaway or man overboard.

The acoustic source 2 or pinger may serve as a means for localizing the wreckage of the vehicle in the event of shipwreck. For this purpose, there is a provision for enabling the electrical supply of the pinger to be maintained by a water-proof battery or sea cell. To identify the position of the boat, standard pinger localization devices are used.

According to a simplified embodiment of the device according to the invention, the pinger is removed from the hull, and it is the acoustic signature of the craft, resulting from all the acoustic emission sources present in it, in the form in which this signature is received by the measuring head of the beacon, that enables it to be localized, in direction only.

The above-mentioned embodiment of the invention assumes that there are several men on board the craft. To adapt this device to the search for shipwrecked lone navigators, a rescue craft, a helicopter or other aircraft may be fitted out with a VHF receiver case. If the castaway's craft has not sunk, the assistance means sent to search for the lone navigator may, after having identified the position of the craft, find the castaway in its vicinity.

In an improved variant of the device according to the invention, designed for the use of lone navigators, the individual alarm pack has a directional acoustic sensor capable of working at depths of several meters under water and of giving, like the beacon of the preceding embodiment, the course of an acoustic source. The acoustic sensor is supported by a wire which is unwound by the castaway himself. The presence of this acoustic head obviously increase the volume of the individual alarm pack to some extent.

The rescue system taken on board the lone navigator's vessel then consists no longer of a beacon but of a small motor-driven, remote-controlled vehicle that is jettisoned if the navigator should fall overboard. This vehicle is fitted out with an electrical motor, controlled by means of signals for the localization of the man overboard or castaway, set up in the individual alarm pack by an electronic circuit associated with the acoustic sensor and emitted by the antenna of this pack. The vehicle is fitted out with an acoustic source or pinger and a control box. The case receives the VHF signals emitted by the alarm pack, these encoded signals containing the bearing and distance of the man overboard or castaway. The remote control of the motor of the vehicle, supplied with these pieces of information, then directs the vehicle towards the castaway or man overboard.

What is claimed is:

1. A device for the rescue of a person who has fallen overboard a nautical vehicle, comprising rescue means that are on board the vehicle and are designed to be put in water under the control of a radioelectric signal automatically emitted by an emitter of signals, built into an alarm pack carried by the person when he reaches the water, this signal actuating a means for jettisoning the rescue means, said device wherein the vehicle is fitted out with a submerged acoustical device to emit acoustical signals in the water and wherein the alarm pack further includes an acoustic sensor which is sensitive to the signals that are propagated in the water from an acoustical device to actuate a radio transmitter for the emission of said radioelectric signal which is then picked up by a receiver installed in said vehicle to trigger the means for jettisoning the rescue means.

2. A device according to claim 1, wherein the alarm pack is designed to be carried by the person by means of a collar forming an antenna for a radio transmitter of the alarm pack.

* * * * *